United States Patent [19]

Rodach

[11] 4,113,198

[45] Sep. 12, 1978

[54] REEL FOR COILING STRIP

[75] Inventor: Alexander Rodach, Pforzheim, Fed. Rep. of Germany

[73] Assignee: Irma Ungerer Geb. Dollinger, Pforzheim, Fed. Rep. of Germany

[21] Appl. No.: 779,465

[22] Filed: Mar. 21, 1977

[30] Foreign Application Priority Data

Aug. 14, 1976 [DE] Fed. Rep. of Germany ..... 2636662

[51] Int. Cl.[2] ..... B21C 17/10

[52] U.S. Cl. ..... 242/78.3; 242/74.1

[58] Field of Search ..... 242/78.3, 74, 74.1, 242/72.1

[56] References Cited

U.S. PATENT DOCUMENTS

| | | | |
|---|---|---|---|
| 2,920,837 | 1/1960 | Wingard | 242/78.3 |
| 3,666,194 | 5/1972 | Gosnell | 242/78.3 |
| 3,840,197 | 10/1974 | Rodach | 242/78.3 |
| 3,854,671 | 12/1974 | Rodach | 242/74.1 |

*Primary Examiner*—Edward J. McCarthy

[57] ABSTRACT

A reel body is formed with a stop. At least three shell portions are mounted on and expansible relative to the reel body and comprise at least one first shell portion and at least one second shell portion. Expanding and clamping means are operable to expand the shell portions relative to said reel body. The expanding and clamping means comprise a first radially movable clamping bar, which is in engagement with the first shell portion and defines a clamping gap therewith and is also in engagement with the second shell portion at one side of the latter, and a second radially movable clamping bar, which is formed with a bearing surface in slidable engagement with the second shell portion on the side thereof opposite to the first clamping bar. The first clamping bar being radially outwardly movable to expand said first shell portion into engagement with the stop and adapted to clamp a strip end portion in the clamping gap when the first shell portion is in engagement with the stop. The second shell portion and the reel body comprise cooperating constraining means permitting the second shell portion to move only parallel to the gap. The second shell portion is arranged to be expanded relative to said reel body parallel to said gap in response to outward radial movements of said first and second expanding bars and constituting a transition member adapted to support a strip portion adjacent to said strip end portion when the latter is clamped in said gap.

9 Claims, 3 Drawing Figures

REEL FOR COILING STRIP

This invention relates to an improved reel for coiling strip, particularly metal strip, in plants for manufacturing and/or processing strip.

Known reels for coiling strip, particularly metal strip, comprise a shell which includes two hinged expansible shell portions, which are adjustable by means of a radially displaceable expanding bar, which engages the shell portions adjacent to their free ends. In these known drums, one of the expansible shell portions defines a gap, in which an end of the strip can be clamped.

The gap is defined on one side by the free side of a first expansible shell portion, which is pivotally movable outwardly as far as to a limiting stop, and on the other side by a clamping surface of the expanding bar. The second expansible shell portion engages the expanding bar and is mounted in a bearing to be movable in the same direction as said expanding bar. Such reel is disclosed in U.S. Pat. No. 3,854,671.

It is an object of the invention to provide a reel which is of the type described but may comprise more than two and preferably four of such expansible shell portions as are required to provide a larger and concentric clearance space between the contracted reel body and the inside surface of a coil or for a concentric mounting of a coil core to enable a coiling of strip without a fluctuating strip tension.

This object is accomplished in that four expansible shell portions are preferably provided and the expansible shell portion which constitutes a transition member is in slidable engagement with a recessed bearing surface of an additional expanding bar and is constrained to move parallel to the clamping gap.

The reel may be designed to permit of a coiling of strip during a rotation of the reel body in either sense. To this end, two clamping gaps for clamping the strip end during a rotation of the reel body in mutually opposite senses are provided and converge from the periphery of the reel body and the expansible shell portions which constitute transition members are in slidable engagement with respective recessed bearing surfaces of an interposed common expanding bar and are constrained each to move parallel to the adjacent gap.

Further details will be described hereinafter with reference to the drawing, which shows two embodiments of the reel according to the invention by way of example.

Figure 1:
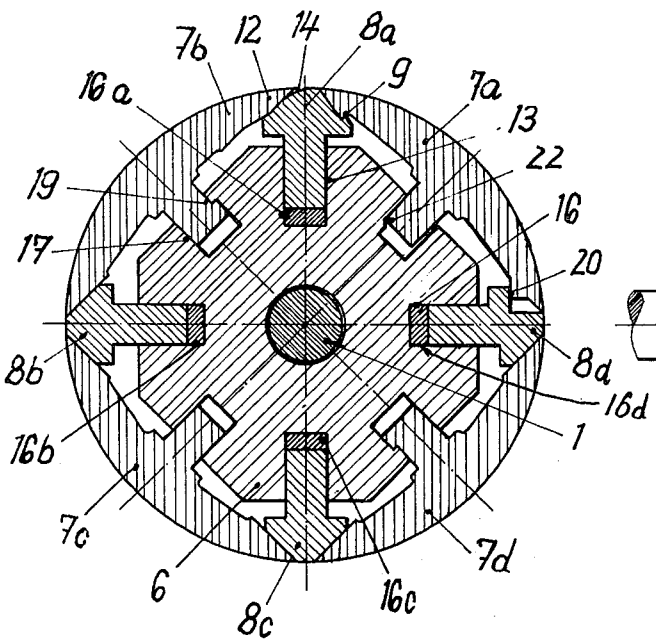

As is apparent from FIG. 1, the reel comprises at the portion at which the leading end of the strip is to be clamped between two expansible shell portions 7*a* and 7*b*, which are movable in an outward direction from the reel body jointly with two additional expansible shell portions 7*c* and 7*d*. The expansible shell portions are operable by expanding bars 8*a* to 8*d*. The expansible shell portion 7*a* and the expanding bar 8*a* have stepped portions, which interengage at 9. The expanding bar 8*a* cooperates with a projection 12 of the expansible shell portion 7*b*, which serves as a clamping member for clamping the leading end of the strip. The expanding bar 8*a* is seated in a respective longitudinal groove 13 and together with the projection 12 defines a narrow gap 14.

Figure 2:
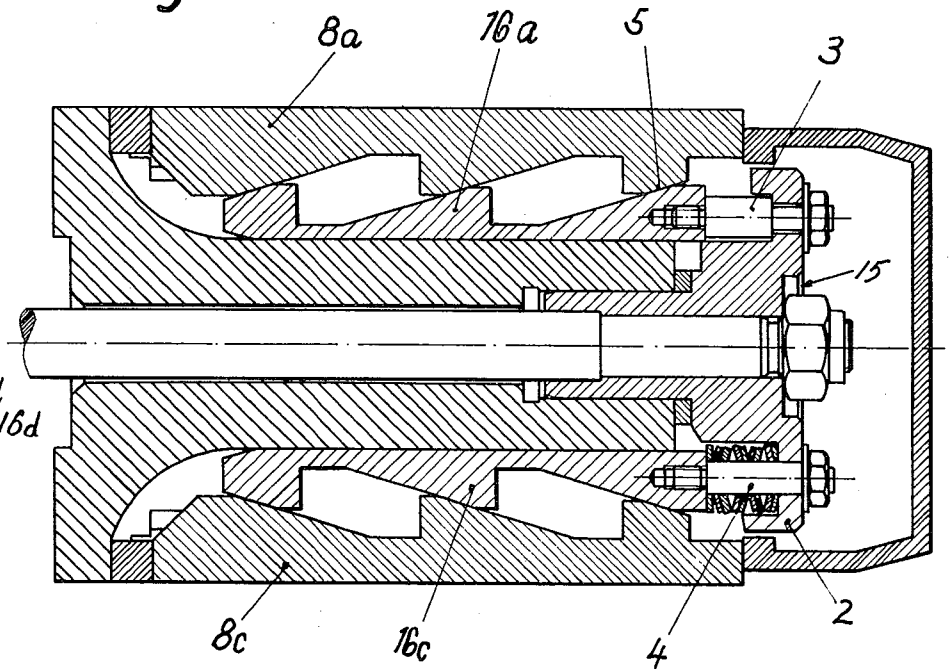
FIGS. 1 and 2 are, respectively, a transverse sectional view and a longitudinal sectional view showing a first embodiment intended for use in one sense of rotation.

It is also apparent from FIG. 2 that the reel is mounted only at one end at 15. The expanding bars 8*a* to 8*d* engage respective wedge bars 16*a* to 16*d*, which are slidably mounted in guiding grooves 13 formed in the reel body 6. The wedge bars 16*a* to 16*d* are longitudinally slidably movable by a hydraulically or pneumatically operable, central rod 1 provided with an enlarged head portion 2 and partly by means of interposed pins 3 and spring-loaded pins 4 to move the expanding bars 8*a* to 8*d* by means of the wedges 5. The pin 3 associated with the expanding bar 8*a* for adjusting the clamping gap 14 is not provided with an interposed spring.

The expansible shell portions 7*a*–7*d* are provided with radial ribs, inwardly projecting from the central inner surface of the shell portions. The reel body 6 is provided with longitudinal radial grooves 17 for cooperation with the radial ribs, and longitudinal radial grooves 13 for cooperation with said expanding bars.

The expansible shell portion 7*b* constitutes a clamping member and has a rib, which is radially slidably guided in a radial groove 17, which is formed in the reel body 6. The outward sliding movement of the rib of shell portion 7*b* in the groove 17 is limited by the engagement of an enlarged foot portion of said rib with a stop 19, which projects inwardly in said groove. The shell portion 7*b* is held against the expanding bar 8*a* by means of springs which are not shown here but in the second embodiment. The expansible shell portion 7*a* serves as a transition member and is guided by a recessed bearing surface 20 of the expanding bar 8*d*. The expansible shell portion 7*a* has a rib, which is radially slidably guided in a respective groove 17 formed in the reel body 6. This groove is substantially parallel to the gap 14.

The expansible shell portion 7*c* has a rib, which is radially slidably guided in a respective radial groove 17 formed in the reel body 6.

The expansible shell portion 7*d* has a rib, which is radially slidably guided in a respective groove 17 formed in the reel body 6. The outward slidable movement of the rib of shell portion 7*d* in its respective groove is limited by the engagement of an enlarged foot portion of said rib with a stop, which projects inwardly in said groove.

Figure 3:
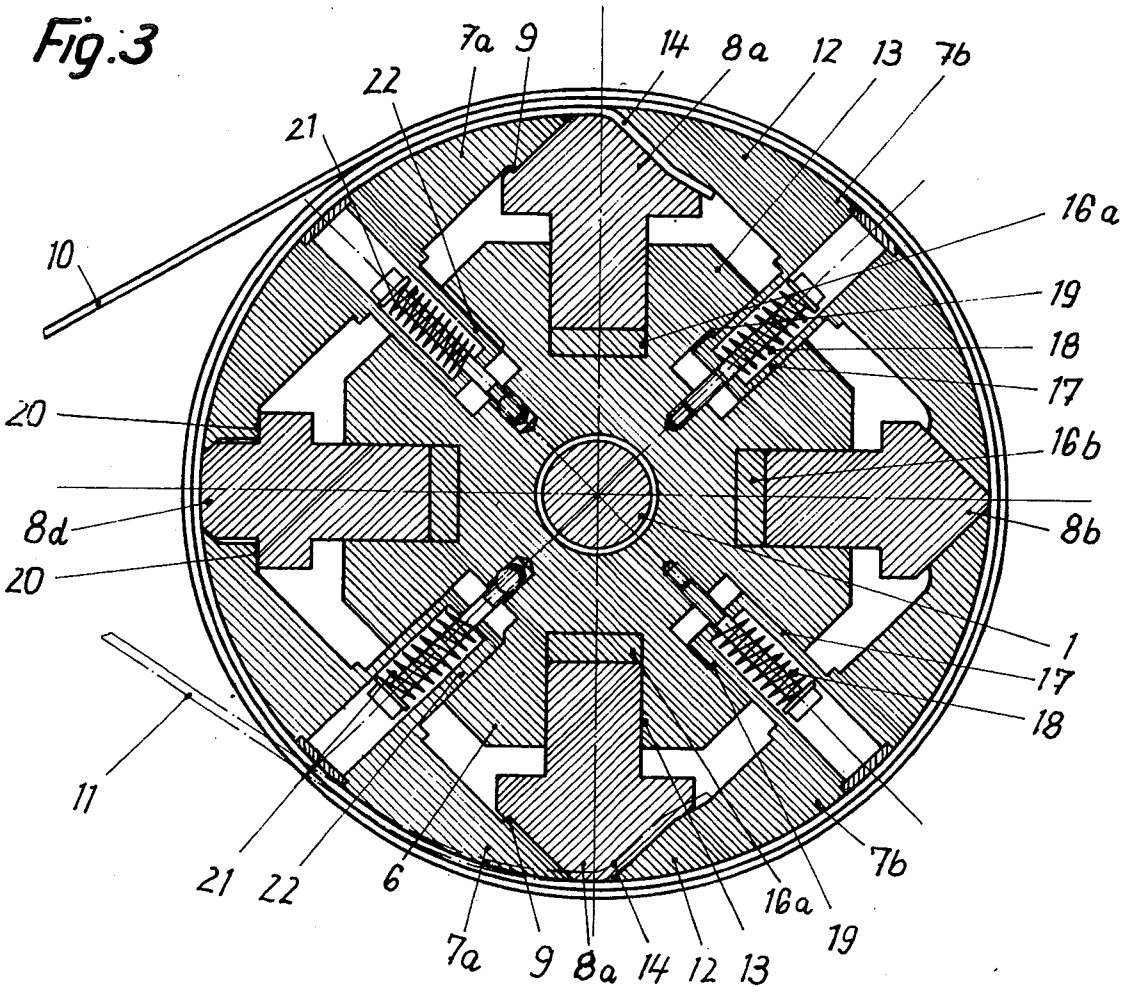
FIG. 3 is a transverse sectional view showing a second embodiment which can be used in either sense of rotation.

The reel shown in FIG. 3 can be used to clamp the leading end portion of a strip to be coiled by a rotation of the drum in either sense. For this reason, the reel has two mutually oppositely disposed gaps 14 for clamping the leading end 10 or 11 of a strip. Each of the expansible shell portions 7*a* has one side portion which interengages with the associated expanding bar 8*a* at 9. On its other side, each of the expansible shell portions 7*a* is in slidable engagement with an associated recessed bearing surface 20. The recessed bearing surfaces in engagement with both expansible shell portions 7*a* are formed in a common expanding bar 8*d*. Each expansible shell portion 7*a* has a rib 22, which is radially slidably guided in a groove formed in the reel body 6. This groove is substantially parallel to the adjacent gap 14.

Each of the expansible shell portions 7*b* has a rib 17, which is radially slidably guided in a groove formed in the reel body 6. The outward slidable movement of the rib of each shell portion 7*b* in its groove is limited by the engagement of an enlarged foot portion of the rib with a stop 19, which projects inwardly in the groove.

The projecting portion 12 of each of the two expansible shell portions cooperates with an associated expanding bar to define one of the clamping gaps 14. These two clamping gaps 14 converge from the periphery of the reel. FIG. 3 shows also the springs 18 and 21 tending to urge the expansible shell portion 7*b* against the expanding bars 8*a*, 8*b* and 8*d* and the springs 21 urging the expansible shell portions against said expanding bars.

What is claimed is:

1. A reel for coiling strip, which comprises a reel body formed with a stop, at least three shell portions which are mounted on and are expansible relative to said reel body and comprise at least one first shell portion and at least one second shell portion, said shell portions having radial ribs inwardly projecting from the inner surface of said shell portions, the rib of said first shell portion having an enlarged foot portion, and expanding and clamping means operable to expand said shell portions relative to said reel body, said expanding and clamping means comprising a first radially movable clamping bar, which is in engagement with said first shell portion and defines a clamping gap therewith and is also in engagement with said second shell portion at one side of the latter, and a second radially movable clamping bar, which is formed with a recessed bearing surface in slidable engagement with said second shell portion on the side thereof opposite to said first clamping bar, said reel body formed with first radial grooves for cooperation with the ribs and second radial grooves for cooperation with said clamping bars, said stop projecting inwardly in a respective one of said first radial grooves, that is in opposition to said foot portion, said first clamping bar being radially outwardly movable to expand said first shell portion, urging said foot portion into engagement with said stop, and adapted to clamp a strip end portion in said clamping gap when said foot portion is in engagement with said stop, said second shell portion and said reel body comprising cooperating constraining means permitting said second shell portion to move only parallel to said gap, and said second shell portion being arranged to be expanded relative to said reel body parallel to said gap in response to outward radial movements of said first and second expanding bars and constituting a transition member adapted to support a strip portion adjacent to said strip end portion when the latter is clamped in said gap.

2. A reel as set forth in claim 1, which comprises four of said expansible shell portions, so as to provide for a concentric mounting of a coil core and to enable coiling of a strip without a fluctuating strip tension.

3. A reel as set forth in claim 1, for coiling a strip during a rotation of the reel in either sense of rotation, comprising two of said first expansible shell portions, two of said second expansible shell portions, two of said first clamping bars, each of which is in engagement with one of said first shell portions and defines a clamping gap therewith and is in engagement with one of said second shell portions at one side thereof, being disposed on opposite sides of said reel and said clamping gaps converging from the periphery of said reel, and a common second clamping bar, which is formed with two recessed bearing surfaces in slidable engagement with respective ones of said second shell portions on the side thereof opposite to the associated first clamping bar.

4. A reel as set forth in claim 1, which comprises means urging said second shell portion against said first clamping bar and against said bearing surface.

5. A reel as set forth in claim 4, in which said urging means comprise spring means acting parallel to said clamping gap.

6. A reel as set forth in claim 1, which comprises means urging all said shell portions against said clamping bars.

7. A reel as set forth in claim 1, in which said reel body is formed with a central bore, said expanding bars are radially guided in respective ones of said grooves, an actuating rod is axially slidably mounted in said bore and has an enlarged head portion operatively connected to said expanding bars, and said actuating rod is axially movable in said bore to impart an outward radial movement to said expanding bars.

8. A reel as set forth in claim 7, which comprises spring-loaded pins operatively connecting said enlarged head portion to at least one of said expanding bars.

9. A reel as set forth in claim 1, in which the constraining means comprise the rib of said second shell portion being guided by a respective one of said first radial grooves.

* * * * *